United States Patent [19]

Harris et al.

[11] 4,028,862

[45] June 14, 1977

[54] PACKAGING CLAMP AND METHOD

[75] Inventors: John L. Harris, Bettendorf, Iowa; Bror H. Nelson, Moline, Ill.

[73] Assignee: Aluminum Company of America, Pittsburgh, Pa.

[22] Filed: Jan. 2, 1976

[21] Appl. No.: 646,062

Related U.S. Application Data

[62] Division of Ser. No. 493,383, July 31, 1974, Pat. No. 3,971,469.

[52] U.S. Cl. ..... 53/3

[51] Int. Cl.[2] ..... B65B 27/00

[58] Field of Search ..... 53/3, 26, 196; 206/448, 206/449, 451, 452, 453

[56] References Cited

UNITED STATES PATENTS

| | | | |
|---|---|---|---|
| 1,770,516 | 7/1930 | Griffith | 206/451 |
| 1,920,837 | 8/1933 | Birdsey | 206/452 |
| 3,709,358 | 1/1973 | Andrews et al. | 206/451 |

*Primary Examiner*—Travis S. McGehee
*Assistant Examiner*—John Sipos
*Attorney, Agent, or Firm*—Daniel A. Sullivan, Jr.

[57] ABSTRACT

A packaging clamp including top bearing means for bearing against a top portion of a material to be packaged, bottom bearing means for bearing against a bottom portion of a material to be packaged, and connecting means, extending between the top and bottom bearing means, for holding the top and bottom bearing means in bearing relationship against respectively a top portion and a bottom portion of material to be packaged.

A packaging method including the steps of placing clamps at a plurality of locations on a material to be packaged, with each clamp bearing against a bottom portion and a top portion of the material to be packaged, and tying lines between the clamps for securing the clamps on the material.

1 Claim, 13 Drawing Figures

PACKAGING CLAMP AND METHOD

CROSS REFERENCE TO RELATED APPLICATION

This is a division of application Ser. No. 493,383, filed July 31, 1974 now U.S. Pat. No. 3,971,469.

BACKGROUND OF THE INVENTION

The present invention relates firstly to a packaging clamp and more particularly to a packaging clamp which is particularly useful for the forming of a package of curved metal plates using, for example, steel strapping extending between several of such clamps and over the plates. Secondly, the present invention relates to a method for utilizing such clamps to form a package of a particular material which is to be packaged.

It is desired to build very large tanks which will be utilized for the transport of LNG (liquified natural gas) from areas of production to regions of consumption. One method of building these tanks uses the idea of welding together a number of spherically curved aluminum sections from which the tan results. Such sections, which are referred to as "orange peel" sections, are illustrated in FIG. 9 of the article "Aluminum and LNG—New Perspective on a Changing Partnership" by George E. Herrman and Donald E. Branscome in the *Pipeline* ɜ *Gas Journal*, June 1973. Typically, the orange peel sections are welded together into the final sphere at a location different from that where the orange peel sections themselves are manufactured. Methods and devices are needed by which these orange peel sections can be shipped. The weights which are involved can be quite large. For example, for a tank having an inner diameter of 35 meters, a package of 8 aluminum plates can weigh more than 53,000 pounds.

SUMMARY OF THE INVENTION

In view of the above, it is an object of the present invention to provide apparatus and method particularly suited for the secure packaging of groups of spherically curved plates.

This as well as other objects which will become apparent in the discussion which follows are achieved, according to the present invention, by providing a packaging clamp including top bearing means for bearing against a top portion of a material to be packaged, bottom bearing means for bearing against a bottom portion of a material to be packaged, and connecting means, extending between the top and bottom bearing means, for holding the top and bottom bearing means in bearing relationship against respectively a top portion and a bottom portion of material to be packaged; and a packaging method, comprising the steps of placing clamps at a plurality of locations on a material to be packaged, with each clamp bearing against a bottom portion and a top portion of the material to be packaged, and tying lines between the clamps for securing the clamps on the material.

DESCRIPTION OF THE PREFERRED EMBODIMENTS

Figure 1:
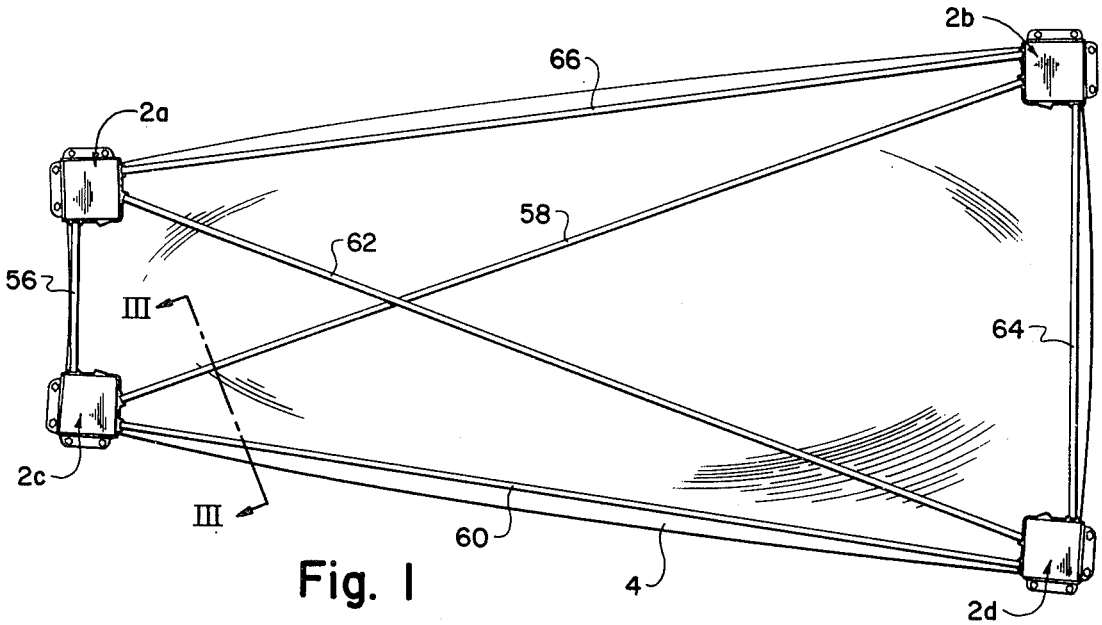
FIG. 1 is a plan view of a package according to the present invention.
Figure 2:
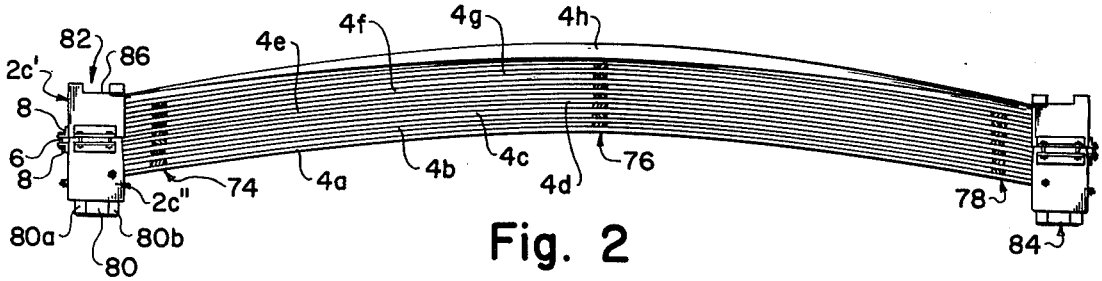
FIG. 2 is an elevational view of the package of FIG. 1.

Referring firstly to FIGS. 1 and 2, packaging clamps 2*a* to 2*d* are assembled on a pile of 8 orange peel sections 4*a* through 4*h*. Each clamp includes a top bearing half, for example, 2*c'* and a bottom bearing half, for example 2*c''*. The top and bottom bearing halves are bolted together by bolts 6, which are assembled in angle irons 8 attached to the sides of the top and bottom bearing halves.

Figure 3:
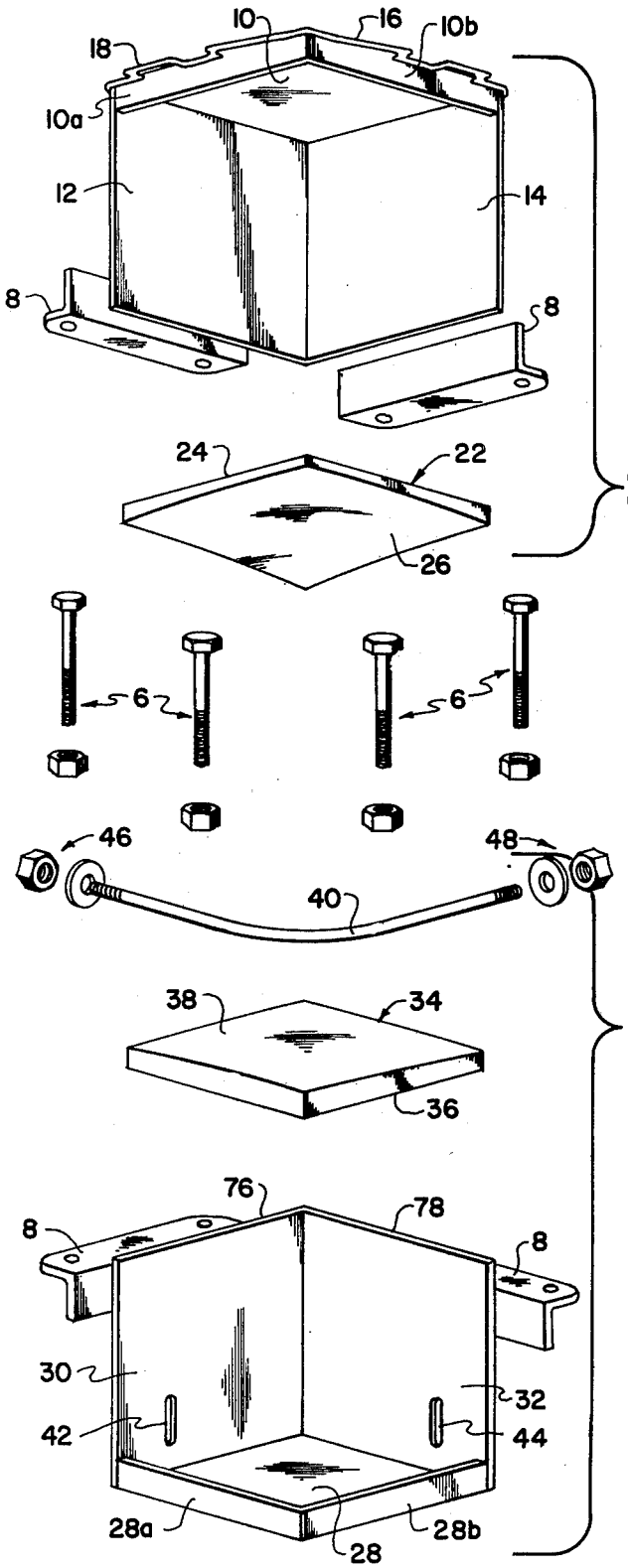
FIG. 3 is an exploded, perspective view from the viewing plane III—III of FIG. 1.

Further details of the construction of these packaging clamps are shown in FIG. 3, which is an exploded, perspective view of clamp 2*c*, as viewed in the direction III—III of FIG. 1. The top bearing half 2*c'* of the packaging clamp includes a lid 10 and sidewalls 12 and 14. Welded around the edge of lid 10 is a rod 16 which has been bent selectively to provide loops, for instance loop 18, for the attachment of lines, for instance strapping, over the top of plate 4*h*.

Lid 10 and sidewalls 12 and 14 are assembled as the three sides of a rectangular parallelepiped, sidewalls 12 and 14 being angled with respect to one another at 90°, the same angular relationship existing between lid 10 and sidewalls 12 and 14 respectively. A seat block 22, made of wood, is formed flat on its upperside 24 to bear flushly against the underside of lid 10 and provided with a spherical curvature 26 on its underside, which spherical curvature is designed to provide a flush bearing of the seat block onto the particular spherically curved plate to be packaged. Slats 10*a* and 10*b* are provided on the two edges of lid 10 opposite those joining with sidewalls 12 and 14, to assist in locating seat block 22.

Spherical curvature 26 may be approximated by a flat surface.

The bottom bearing half is likewise constructed in form of three sides of a rectangular parallelepiped, there being in this case floor 28 and sidewalls 30 and 32. Seat block 34 of wood is provided with a flat undersurface 36 and a spherically curved upper surface 38, both surfaces thus being designed to bear flushly on respectively floor 28 and the undersurface of plate 4*a*. Again, surface 38 may be given a flat surface as an approximation of spherical curvature. Slats 28*a* and 28*b* correspond to the slats 10*a* and 10*b* on lid 10. Tie rod 40 is secured at slots 42 and 44 in sidewalls 30 and 32, respectively, using nut and washer sets 46 and 48. These slots permit some adjustment capability up and down. Also shown in FIG. 3 are the head shank and nut portions of the bolts 6 which are used to fasten the top bearing half *2c'* to the bottom bearing half *2c''*. The angle irons 8, to which the bolts 6 fasten, have been exploded off of the reverse sides of the sidewalls 12, 14, 30 and 32. The perspective nature of FIG. 3 distorts somewhat the relationship of angle irons 8 to sides 30 and 32 when these are assembled. In assembly, angle irons 8 are down from the edges 76 and 78. Compare FIG. 5.

Figure 5:
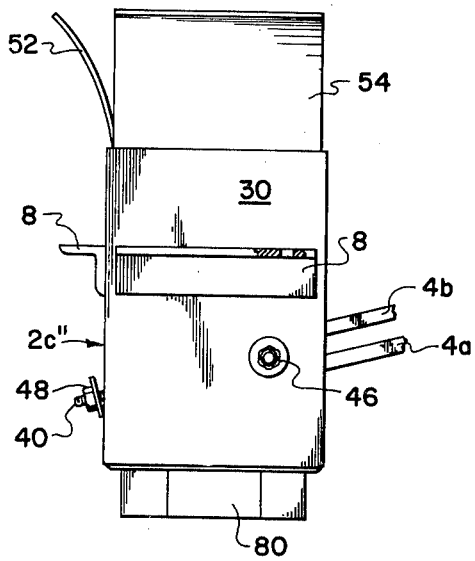
FIG. 5 is an elevational view of the structure shown in FIG. 4.
Figure 4:
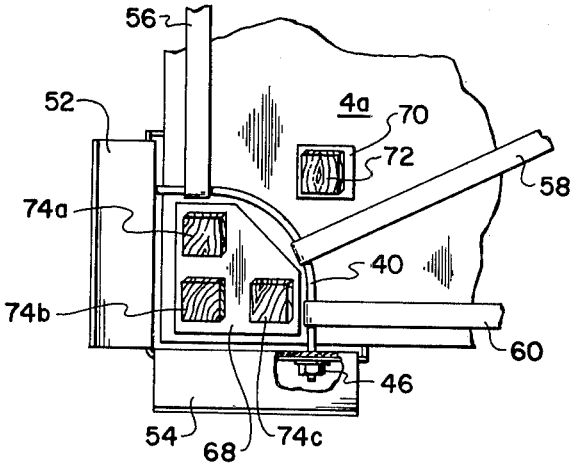
FIG. 4 is a plan view of a portion of the package of FIG. 1 during package assembly.

Referring now to FIGS. 1 to 5, an embodiment of the method of the present invention will be described. Shown in FIGS. 4 and 5 is the bottom bearing half *2c''* of packaging clamp *2c*. In assembling the package, first the four bottom bearing halves *2a''* to *2d''* are situated correctly spaced and oriented on a floor. In the illustrative case of the bottom bearing half *2c''*, depicted in FIGS. 4 and 5, the unit made up of sidewalls 30 and 32 and floor 28 is what is first placed down. Then seat block 34 is laid in place on floor 28. This is followed by the setting in of shimboards 52 and 54. The purpose of the shimboards is to assist in guiding the plates down into the four bottom bearing halves. They additionally protect the edges of the plates from the metal sidewalls 30 and 32, when plates are in the package. The shimboards are bent back at their top to facilitate the lowering of the plates into the bottom bearing halves. This bending back may be done by tieback means, if shimboards are used that overly resist the shown permanent set.

With the shimboards in place, the first plate, plate *4a*, is set down in place. Then, in the case of bottom bearing half *2c''*, tie rod 40 is mounted through holes 42 and 44 using both nut and washer sets 46 and 48. The corresponding tie rods of the bottom bearing halves *2a''*, *2b''*, and *2d''* are likewise mounted. With the tie rods assembled in each corner, there follows a strapping operation in which a set of steel bands 56, 58, 60, 62 , 64 and 66 are attached tightly over the upperside of plate *4a*, between the tie rods in the corners. It is to be noted here that the inside of the curvature of plate *4a* faces downwards and that the bands pass over the upperside of plate *4a*, i.e., over the outside of its curvature. This holds plate *4a* tightly against the bottom bearing halves, and vice versa, and has the additional advantages that the bands are not strung out in the empty space below plate *4a*, i.e., on the inside of its curvature, where the bands would be exposed to being caught and broken, and that it becomes possible to stack the package of FIG. 2 on top of a similar package. This last advantage provides for compact stacking of packages for storage and transportation, since the packages can be nested or interlocked.

Following this first strapping operation, tape pieces 68 and 70 are applied to the upper surface of the plate *4a*. This tape is adhesive on both sides, so that wooden spacer blocks 72 and 74*a*, 74*b*, and 74*c* can be set in place without danger of their being displaced by, for example, a jarring of the package before the next plate *4b* has been set down on top of them. While four blocks are placed in each corner in this example, the total number of blocks and thus the total wood block bearing area in each corner may be adjusted to support the load arising if a number of packages as in FIG. 2 are stacked one on top of the other. Corresponding tape pieces and blocks are applied at the other three bottom bearing halves at the other three corners. Additionally, tape and wooden block sets are placed at regions 74, 76 and 78.

With all wooden spacer blocks in place, plate *4b* is set down in place, this being followed by a corresponding arrangement of wooden spacer blocks as done for plate *4a*. In this way, the eight plates through *4h* are set in place. Sidewalls 30 and 32 are of sufficient height that the corner of the last plate *4h* still falls below their upper edges 76 and 78.

Following the laying-in of plate *4h*, the shimboards 52 and 54 are cut off flush with the edges 76 and 78.

There follows the setting of the top bearing halves, with the seat blocks, e.g. seat block 22, in place, onto each corner of plate *4h*. The sidewalls of the top bearing halves overlap with the sidewalls of the bottom bearing halves, i.e. sidewalls 30 and 32 extend a substantial distance above the lower angle irons 8 to fit witin sidewalls 12 and 14. Bolts 6 are then used to connect the top bearing half with the bottom bearing half at each corner. In this connection, it will be noted that the provision of two bolts spaced along each sidewall has the advantage of assuring that there is no canting of, for example, seat block 22 off of the part of the upper surface of plate *4h* on which the seat block is to bear. Rather, there is achieved a well-distributed bearing of the seat block on the plate, over the entire surface of the seat block. This type of connection is referred to herein as an anit-cant securement.

With bolts 6 in place at all corners, a top set of bands 56 through 66 is tied between the corners by an appropriate strapping operation, the bands being attached to the loops on rod 16 and similarly at the other corners. This completes the package and assures that the packaging clamps are secured on the plates. The package is then ready to be lifted by the placing of lifting straps through channels 80 and 84. In this connection, it is noted that the legs, e.g. legs 80*a* and 80*b*, are spaced and arranged such that they can seat in the cups, e.g. cup 82, of the top bearing halves of similarly sized packages. The cup walls are notched as at 86 to make it possible to put a lifting strap through a channel 80 resting in the cup.

Figure 6:
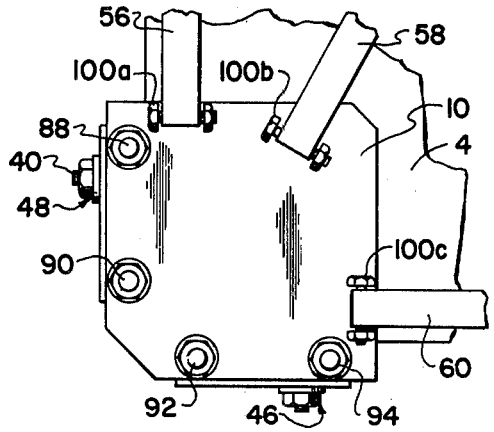
FIG. 6 is a plan view of a portion of a package according to the present invention, using an alternate packaging clamp.
Figure 7:
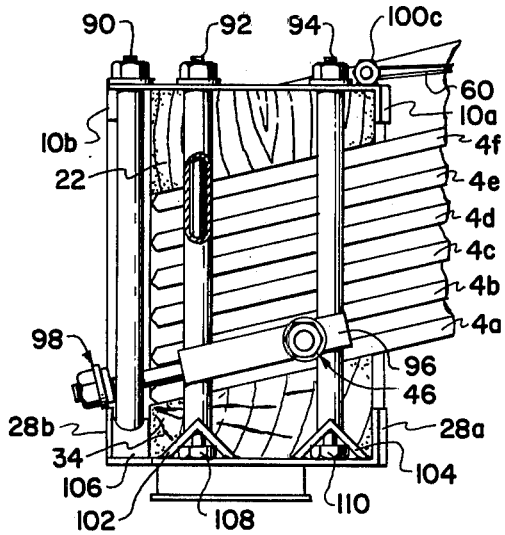
FIG. 7 is an elevational view of the structure shown in FIG. 6.

Referring now to FIGS. 6 and 7, there is illustrated an alternate embodiment of the packaging clamp of the present invention. Parts in FIGS. 6 and 7 which are the same as those in the embodiment of FIGS. 1, 2 and 3 are given identical numerals. Only areas of structural difference are described here in detail. Characteristic of this embodiment is that sidewalls 30 and 32 and bolts 6 of the embodiment of FIGS. 1 to 3 have been replaced by four bolts 88, 90, 92 and 94. The shanks of these bolts are covered by polyvinyl chloride pipe, which acts in the manner of shims 52 and 54 in the embodiment of FIGS. 1 to 3 to protect the edges of the plates. Tie rod 40 is attached at holes drilled in the edges of two angle irons 96 and 98. These angle irons are slid onto the bolts, which pass through two appropriately drilled holes in each iron. The upper set of bands are connected to nut and bolt assemblies 100*a*, 100*b* and 100*c*, which have been welded on the flats of their heads and nuts to lid 10.

The method of assembly of the package based on the packaging clamps of FIGS. 6 and 7 is essentially the same as that described above with respect to FIGS. 1 to 5. First, the floors of the bottom bearing halves are situated at four corner locations on a floor, spaced and oriented according to the particular orange peel section to be packaged. Next, the seat blocks 34 are installed, this being followed by the lowering of plate 4*a* into position. There follows the installing of the four bolts 88, 90, 92 and 94 of every corner, this being accomplished with the aid of inverted angle iron segments, e.g. 102, 104, 106. These segments are drilled for the passage of the shanks of the bolts. The provision of square nuts 108, 110 allows the bolts to be tightened into connection with floor 28, without the aid of a wrench for holding the nuts stationary. Following this, the polyvinyl chloride pipe sections are slid onto the bolts. Next, the angle irons 96 and 98 are slid down the bolts and come to rest against the upper surface of plate 4*a*. This is followed by the installing of tie rod 40. The lower set of steel bands are then strapped between the four corners and tightened. There follows the loosening of the nuts in nut and washer sets 46 and 48 for the purpose of allowing the bolts 88, 90, 92 and 94 to spread somewhat for the insertion of additional plates into the package. This is followed by the alternate placing of wood spacers and additional plates, up to plate 4*f* in this case. Next, the top bearing halves, including wooden seat blocks 22 and lid 10, are set in place, with the upper nuts being assembled onto the shanks of the bolts 88, 90, 92 and 94 and tightened up. Again, the provision of two spaced bolts on each side of every corner secures against canting of the seat blocks off of a flush bearing relationship on the plates. There follows the strapping of the upper bands in place between the corners, from the loops formed by bolt assemblies 100*a*, *b* and *c*, and the tightening of the nuts in nut and washer sets 46 and 48.

Figure 9:
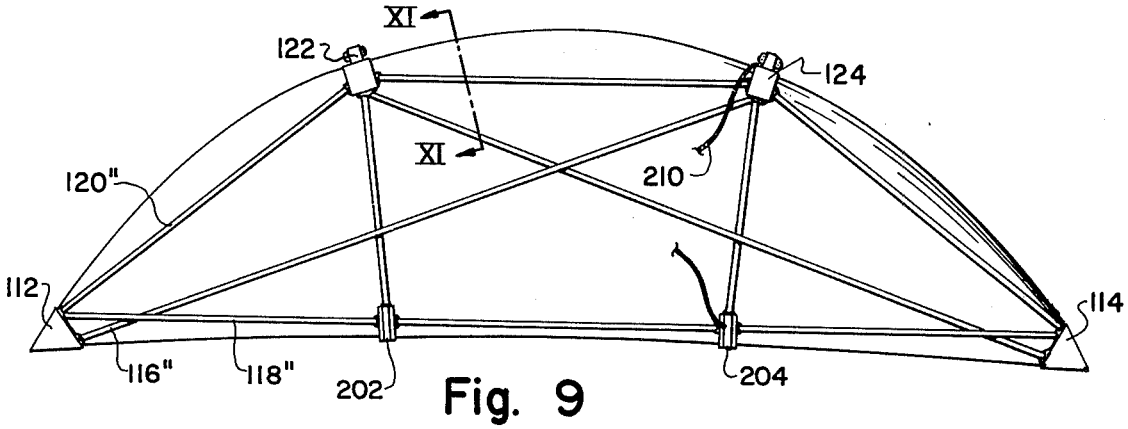
FIG. 9 is a plan view of the package of FIG. 8.
Figure 8:
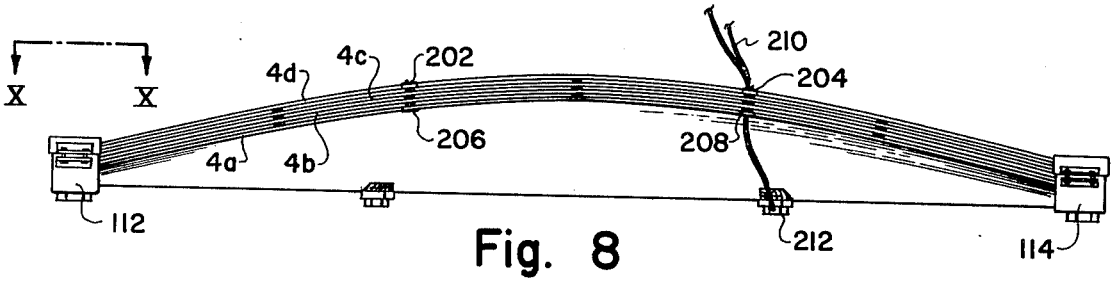
FIG. 8 is an elevational view of an alternate package according to the present invention.
Figure 10:
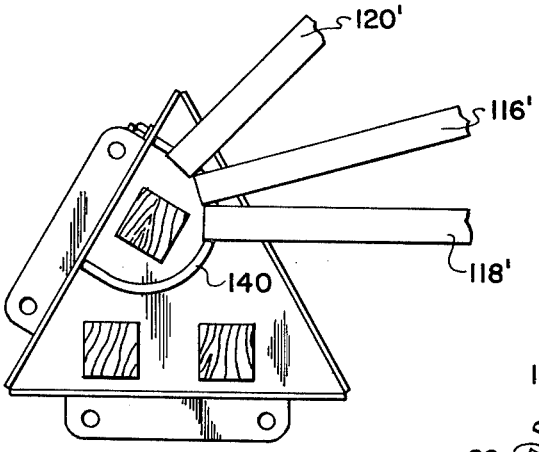
FIG. 10 is a portion of the package of FIGS. 8 and 9, as viewed from the viewing plane X—X of FIG. 8.

Referring now to FIGS. 8 and 9, the embodiment illustrated there shows that the packaging clamp of the present invention can as well have a triangular configuration in its top view, as demonstrated by clamps 112 and 114. As illustrated in FIG. 10, where the top bearing half has been removed, these clamps 112 and 114 differ from those illustrated in FIGS. 1 to 5 additionally in that their tie rod 140 is fastened at both ends to only one of the sidewalls of the bottom bearing half. Also there is a switching of the order of the bands at the corner, the order being on the top plate band 116″, band 118″, and band 120″, while the order on the bottom plate 4*a* is 118′, 116′, and 120′.

Figure 11:
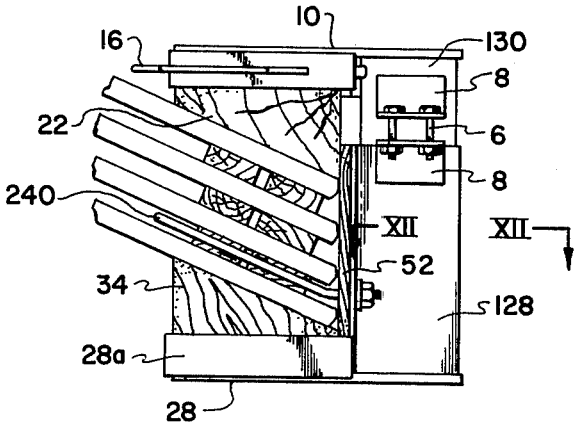
FIG. 11 is an elevational view of a portion of the package of FIGS. 8 and 9, as viewed from the viewing plane XI—XI of FIG. 9.
Figure 12:
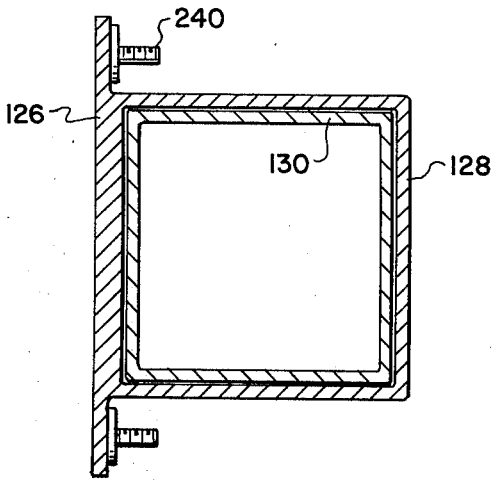
FIG. 12 is a cross-sectional view taken on the cutting plane XII—XII of FIG. 11.

The embodiment of FIGS. 8 and 9 also illustrates another embodiment of a packaging clamp according to the present invention. This clamp can be arranged along a side of a group of plates rather than at a corner. Of concern here are packaging clamps 122 and 124, which are illustrated in greatest detail in FIGS. 11 and 12. Parts substantially identical to those in the embodiment of FIGS. 1 to 5 have been given identical numbers. In this embodiment, the two ends of tie rod 240 come out onto sidewall 126. Attached to and forming part of this sidewall 126 is a tube 128 of square or rectangular cross section. This tube 128 is also attached to floor 28. A similarly shaped tube 130 is secured to lid 10. Tube 130 telescopes in tube 128. In this embodiment, angle irons 8 are attached to the tubes 128 and 130. The bolts 6 on the side shown in FIG. 11 and a corresponding set of two bolts on the reverse side again act to secure against canting, but the anti-canting action is, in this instance, reinforced by the telescoping fit of tubes 128 and 130.

Returning now particularly to FIGS. 8 and 9, it will be noted that additionally provided are sling retainers 202, 204, 206, and 208. They are in the form of C-clips. Sling retainers 202 and 204 slide onto plate 4*d*, while 206 and 208 go on plate 4*a*. The upper part of each clip is provided with rods bent into loops for the attachment of bands as shown. The rod for the attachment of the bands going to clamps 122 and 124 is in the shape of a U, with the bottom of the U forming the band-attachment loop. The legs of this U are extended back across the top of the clip and protrude beyond the clip a certain distance to form a lifting-sling retention area. A portion of a lifting sling 210 is shown in FIGS. 8 and 9, it being retained by the ends of the U's of sling retainers 204 and 208 and by its passing through channel 212 in clamp 124.

Figure 13:
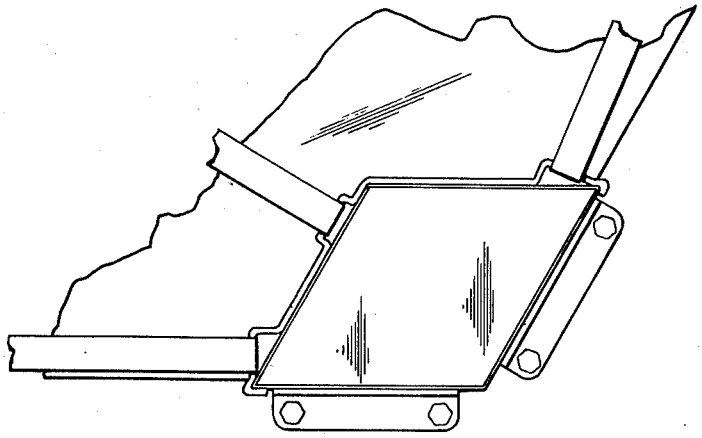
FIG. 13 is a plan view of a portion of an alternate package according to the present invention.

FIG. 13 illustrates that the packaging clamp of the present invention can have an oblique configuration in its top view.

It will be understood that the above description of the present invention is susceptible to various modifications, changes and adaptations, and the same are intended to be comprehended within the meaning and range of equivalents of the appended claims.

What is claimed is:

1. A packaging method, comprising the steps of placing clamps at a plurality of locations on a material to be packaged, with each clamp bearing against a bottom portion and a top portion of the material to be packaged, and tying lines between the clamps for securing the clamps on the material; wherein the material to be packaged is a plurality of curved plates, the step of placing clamps including arranging clamp lower halves at desired locations on the bottom of the plate which is to form the bottom plate of the final package, the inside of the curvature of the bottom plate facing downwards, the step of tying lines including tying lines between the bottom halves of the clamps, the lines passing over the outside of the curvature of the bottom plate, the step of placing further including placing the remainder of the plates over the bottom plate, the insides of the curvatures of said remainder of the plates facing downwards, putting clamp top halves in position against the top plate of the package, and connecting the top and bottom halves of each clamp together for maintaining the bearing relationship of the top and bottom halves of the clamps against the top and bottom portions of the piled plates, and the step of tying lines further including tying lines between the clamps and passing over the outside of the curvature of the top plate.

* * * * *

UNITED STATES PATENT AND TRADEMARK OFFICE

CERTIFICATE OF CORRECTION

PATENT NO. : 4,028,862

DATED : June 14, 1977

INVENTOR(S) : John L. Harris et al.

It is certified that error appears in the above-identified patent and that said Letters Patent are hereby corrected as shown below:

| | |
|---|---|
| Col. 1, line 23 | Change "tan" to --tank--. |
| Col. 1, line 28 | Change "J" to --&--. |
| Col. 4, line 19 | Change "witin" to --within--. |
| Col. 4, line 29 | Change "anit-cant" to --anti-cant--. |

Signed and Sealed this

*twenty-third* Day of *August 1977*

[SEAL]

*Attest:*

RUTH C. MASON
*Attesting Officer*

C. MARSHALL DANN
*Commissioner of Patents and Trademarks*